US007178602B2

(12) United States Patent
Hiorth et al.

(10) Patent No.: US 7,178,602 B2
(45) Date of Patent: Feb. 20, 2007

(54) METHOD AND DEVICE RELATED TO A RETRIEVABLE WELL PLUG

(75) Inventors: Espen Hiorth, Trondheim (NO); Frode Andersen, Heimdal (NO); Thomas Gunnarshaug, Trondheim (NO)

(73) Assignee: Brönnteknologiutvikling AS, Trondheim (NO)

( * ) Notice: Subject to any disclaimer, the term of this patent is extended or adjusted under 35 U.S.C. 154(b) by 339 days.

(21) Appl. No.: 10/643,835

(22) Filed: Aug. 19, 2003

(65) Prior Publication Data

US 2004/0194969 A1 Oct. 7, 2004

(51) Int. Cl.
*E21B 23/00* (2006.01)
*E21B 23/02* (2006.01)

(52) U.S. Cl. ..... 166/382; 166/118

(58) Field of Classification Search ..... 166/210, 166/216, 217, 125, 134, 196
See application file for complete search history.

(56) References Cited

U.S. PATENT DOCUMENTS

| | | | | |
|---|---|---|---|---|
| 3,055,431 | A | 9/1962 | Clark et al. | |
| 3,318,384 | A | 5/1967 | Brown | |
| 3,420,306 | A | 1/1969 | Brown | |
| 3,467,184 | A | 9/1969 | Young | |
| 3,516,493 | A | 6/1970 | McGill | |
| 4,671,356 | A * | 6/1987 | Barker et al. | 166/285 |
| 4,791,988 | A | 12/1988 | Trevillion | |
| 6,311,778 | B1 | 11/2001 | Carisella et al. | |
| 6,318,461 | B1 | 11/2001 | Carilsell | |
| 6,640,894 | B2 * | 11/2003 | Bloom et al. | 166/212 |
| 6,827,150 | B2 * | 12/2004 | Luke | 166/387 |

FOREIGN PATENT DOCUMENTS

| | | |
|---|---|---|
| EP | 0460993 A2 | 12/1991 |
| EP | 0460993 A3 | 2/1993 |

* cited by examiner

*Primary Examiner*—Frank Tsay
(74) *Attorney, Agent, or Firm*—Bracewell & Giuliani LLP

(57) ABSTRACT

A retrievable well plug has a through shaft (12) with link connections (62, 64) and a packer element (66). By pushing the link connections (62, 64) and the packer element towards each other, the link connections (62, 64) and the packer element (66) expand radially, such that a mechanical barrier for the packer element (66) is formed. The links (76; 174, 176) have a generally T-shaped cross sectional profile and include an arm (78) with an end (80) meant for fastening to the fastening devices (72, 74). The other end of the arm (78) fastens to the second link (77) of the link connection (62, 64). Upper supporting surfaces (84, 86; 184; 192, 194) of the links (76; 174, 176) form an approximately tight mechanical barrier against the packer element (66) in an expanded position. The anchoring device (20) has a number of gripping devices (22), wherein the gripping devices (22) at setting of the well plug (10) expand radially, thereby providing an anchoring of the well plug (10) to the well bore wall.

16 Claims, 14 Drawing Sheets

METHOD AND DEVICE RELATED TO A RETRIEVABLE WELL PLUG

CROSS-REFERENCE TO RELATED APPLICATION

This application claims the benefit of Norwegian Patent Application No. 20031489, filed on Apr. 5, 2003, which hereby is incorporated by reference in its entirety.

BACKGROUND OF THE INVENTION

1. Technical Field of the Invention

The present invention relates to a method for use of a retrievable well plug according to claim 1. Further, the invention relates to a retrievable well plug device according to the introduction of claim 4. Further, the invention relates to a well plug anchoring device to keep the well plug in position under pressure according to claim 17.

2. Background of the Invention

Well plugs are used, for example, for zone isolation of oil and gas wells. Such well plugs often have an expandable packer element made of elastic rubber, which seals the well bore for fluid and pressure, and an expandable anchoring device, which is used to hold the well plug in position under pressure. Often, the well plug must pass narrower sections in oil and gas well bores, such as valves and nipples, for thereafter to be set at a wider tube diameter.

Known technology requires use of long well plugs to satisfy these expansion requirements. The prior art is represented by the Norwegian Patents 304615 and 301945 in the name of Bremiteknologiutvikling AS (corresponding to U.S. Pat. No. 6,142,227 and U.S. Pat. No. 6,234,249), describing a retrievable well plug having an upper packer element and a lower packer element connected to each other via a linking-connection. As the packer elements are pushed towards each other, the linking-connection expands radially and makes a mechanical barrier for the packer elements as the packer elements expand axially and results in a tight sealing plug in the well bore. These inventions have features that need to be improved.

The packer concept comprises two symmetrical packer elements making up a seal from each side, and a mechanical barrier therebetween. This concept requires long travel or so-called setting movement to achieve a sufficient expansion for sealing.

The mechanical barrier is made of several expandable linking-pairs fastened to the rest of the plug by means of bolts. Such a fastening device will place restrictions on the number of linking-pairs to be used, and consequently also place restrictions on the sealing quality of the mechanical barrier.

The described well plug uses a split pipe and the above-mentioned linking-pairs as a mechanical barrier to cause a plastic deformation for optimum sealing. This can cause problems when the well plug is to be retrieved.

A possible disruption of one of the two symmetrical packer elements can result in a removal of mechanical connection between the upper part of the well plug and the expanding anchoring device. Consequently loosening of the anchoring device at the time of retrieval of the well plug becomes difficult.

The described anchoring device provides a limitation of the expansion of the well plug, and requires a long setting wandering (setting movement) to achieve sufficient anchoring force towards the pipe wall.

SUMMARY OF THE INVENTION

An object of the present invention is to provide a setting method such that sufficient anchoring of the well plug towards the pipe wall is maintained before the start of the packer element expansion, so that the well plug can be set in a well with liquid and or gas flow.

A further object of the present invention is to provide a retrieval method whereby the anchoring of the well plug towards the pipe wall is maintained until the packer element is in a contracted state, so that the well plug can be retrieved from a well with liquid and/or gas flow.

A further object of the present invention is to provide a retrievable well plug which avoids the abovementioned disadvantages. An object is to provide a physically tight mechanical barrier on each side of one packer element, thereby forming the two mechanical barriers in expanded position constituting radial walls which prevent extrusion of the packer element under strain of pressure.

A further object of the present invention is to provide an anchoring device offering larger radial expansion in relation to the axial setting movement.

A further object is to provide a safety device ensuring that both the anchoring device and the linking connections can be contracted and held in a contracted position during setting and retrieval of the well plug, even if an disruption of the packer element has occurred.

The Invention

The objects mentioned above are achieved with the method and the devices having features as stated in the characterizing part of claims 1, 4 and 7. Further features appear from the dependent claims.

BRIEF DESCRIPTION OF THE DRAWINGS

In the following section the present invention and different embodiments thereof will be described with reference to the enclosed drawings, where.

DETAILED DESCRIPTION OF THE PREFERRED EMBODIMENT

In the following description, a well plug 10 comprises an anchoring device 20, a packer element with two mechanical barriers 60 and a control device 200 mechanically or in other ways connected to the surface of the well, such that setting and removing the well plug 10 can be controlled as required.

Figure 2A:
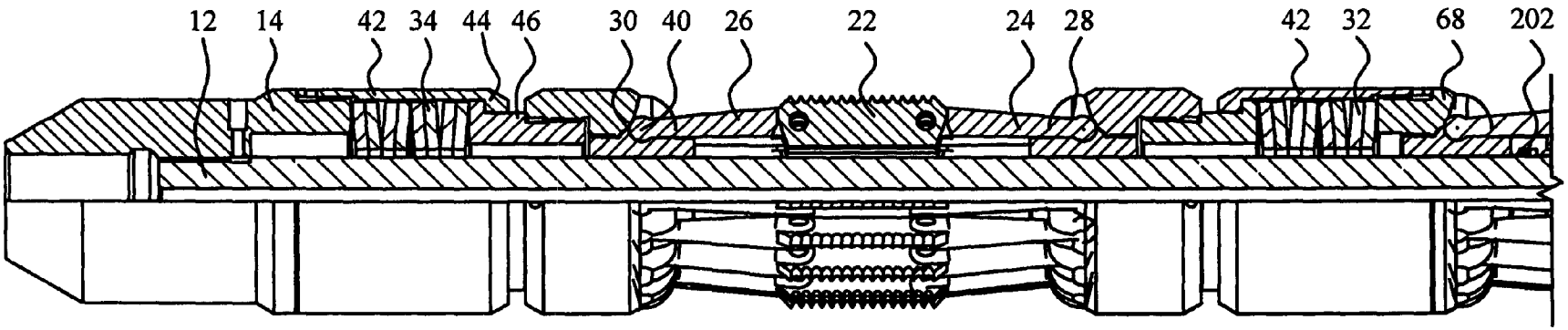
FIG. 2*a* shows a cross sectional view of the anchoring device in the contracted state.
Figure 2B:
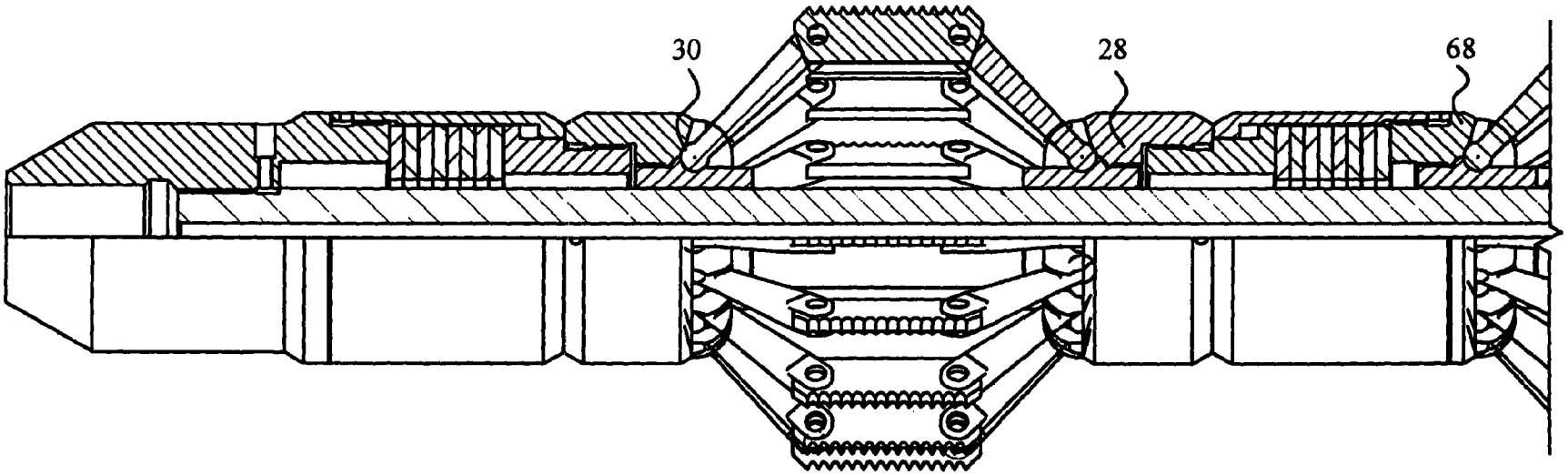
FIG. 2*b* shows a cross sectional view of the anchoring device in the expanded state.
Figure 2C:
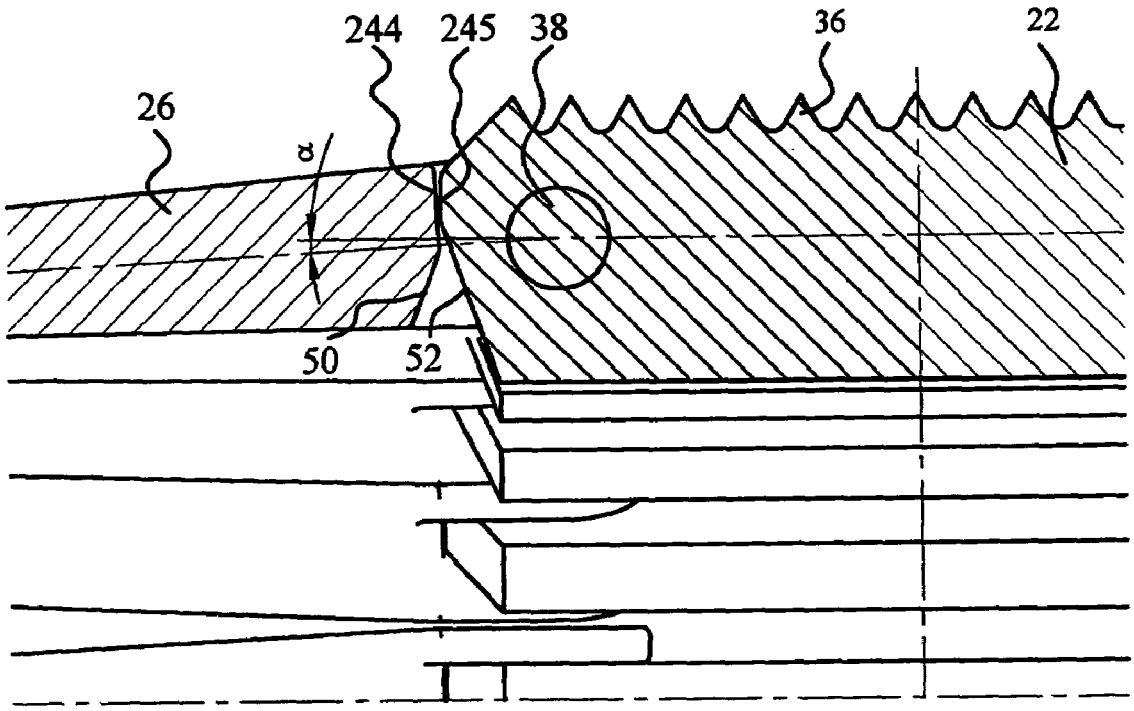
FIG. 2*c* snows a cross sectional view of a detail of the anchoring device.

The anchoring device 20 will now be described with reference to FIG. 2*a*, 2*b* and 2*c*, and comprises a gripping device 22 fastened via pivotal link connections 24, 26 on both sides of the gripping device 22 to respective securing devices 28, 30. The securing devices 28, 30 are axially displaceable along the shaft 12 of the well plug 10, and have spring devices 32, 34 on both sides. Consequently, the spring device 34 is placed between the axially displaceable spring device 34 and a secured end 14 of the well plug 10, while the spring device 32 is placed between the axially displaceable spring device 32 and an axially displaceable securing ring 68 for the packer element with two mechanical barrier 60, which will be described in detail further below.

The gripping device 22 is comprised of a preferably metallic rail with teeth 36. There are fastening means 38 (FIG. 2*c*), such as bolts or similar for fastening the rail to the respective link connections 24, 26. Preferably, the link connections comprise an end shaped as a sphere 40, adapted to recesses in the securing devices 28, 30. The anchoring device preferably comprises at least three such gripping devices 22 with respective link connections.

Figure 14A:
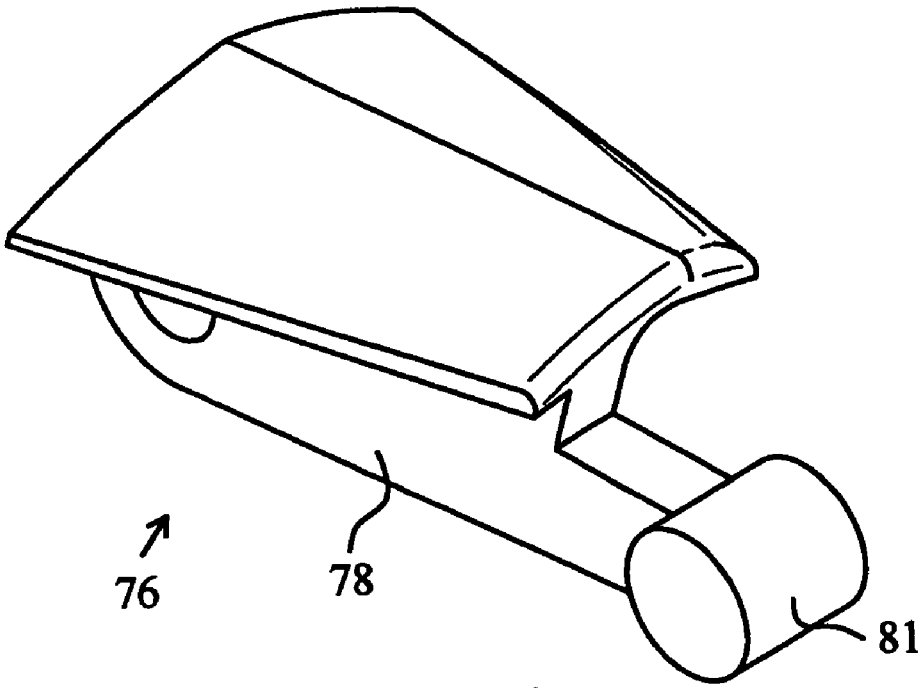
FIGS. 14*a* and 14*b* show alternative embodiments of the ends of the links shown in FIG. 7 and in FIG. 10.
Figure 14B:
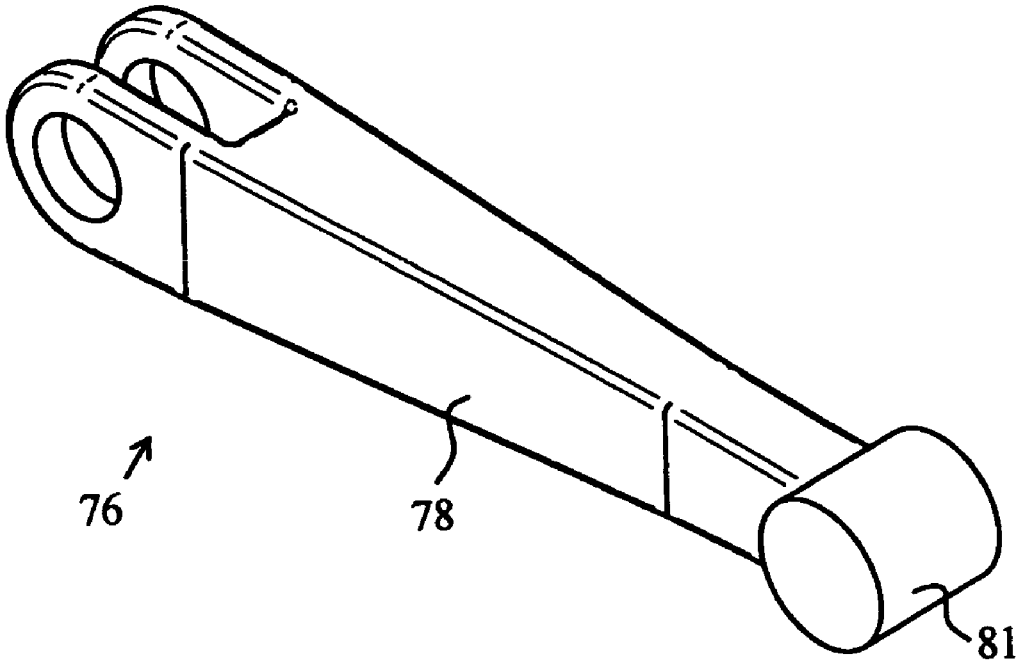

An alternative embodiment of the ends of the link connections are shown in FIG. 14*a* and FIG. 14*b*. Here, an arm 78 of links 76 and 77 are shown with a cylindrical end 81 instead of a spherical end 80.

Figure 9:
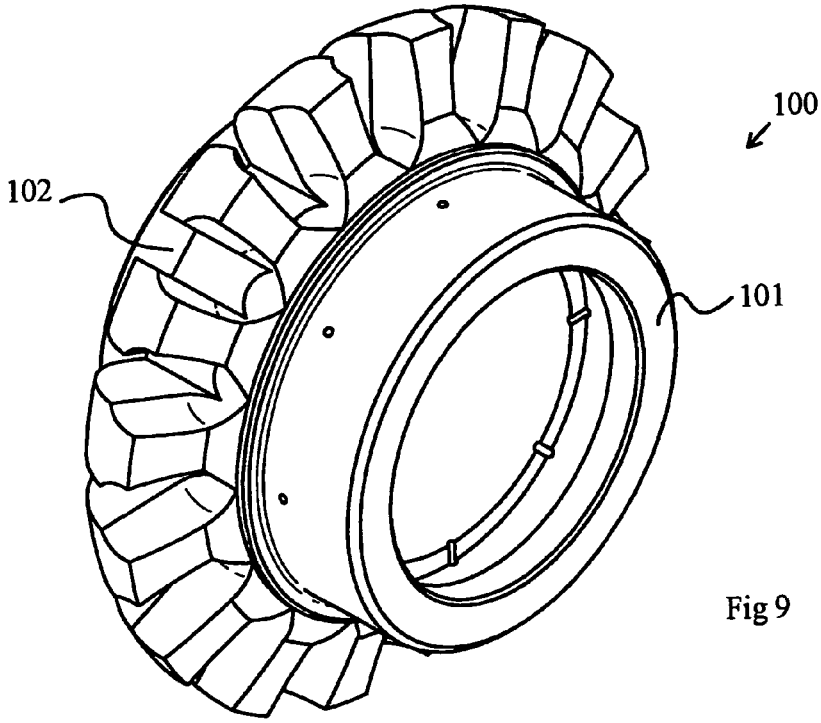
FIG. 9 shows a perspective view of a fastening device for the link pairs.
Figure 10:
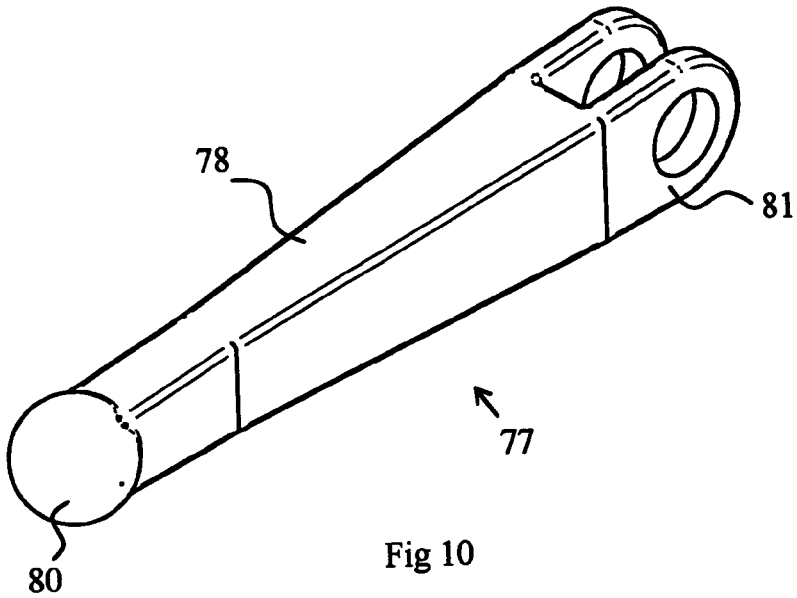
FIG. 10 shows the second link of the link pairs above.

Preferably, the securing devices 28, 30 are of the same type as the fastening devices for the packer elements with mechanical barrier 60. These are shown in FIG. 9. Preferably, the link connections 24, 26 comprise a type of links that also can be used with the packer element with mechanical barrier 60. They are shown in FIG. 10. They will be described further below in detail.

The spring device 34 is surrounded by a protective sleeve 42. The protective sleeve 42 has a radially inwardly directed edge 44, which limits the axial displacement of the securing device 30 because of its radially outwardly directed edges 46. The spring device 34 operate with an axial outwardly directed force, such that the edge 44 of the sleeve 42 is forced towards the edge 46 of the securing device 30. The construction and the operation of the spring device 32 is similar.

Also to be noted is the displacement means 202 in FIGS. 2*a* and 2*b*, described in detail below.

It is very important that the anchoring device 20 moves radially outwards at setting. This is achieved by the gripping device 22, when in contracted state, being at an angle a between the longitudinal axis of the well plug 10 and a line between the pivot axis of the bolt 38 and the pivot axis of the ball 40. This is shown in FIG. 2*c*. Further, the link connection 24, 26 has a supporting surface 244, preferably formed parallel in relation to a supporting surface 245 of the gripping device 22, thereby preventing the said angle a from becoming negative, and accordingly preventing an equal radial expansion of the link connection 24, 26. Further, the link connection 24, 26 preferably is formed with a supporting surface 50 to bear against a supporting surface 52 of the gripping device 22 in expanded position.

Figure 3A:
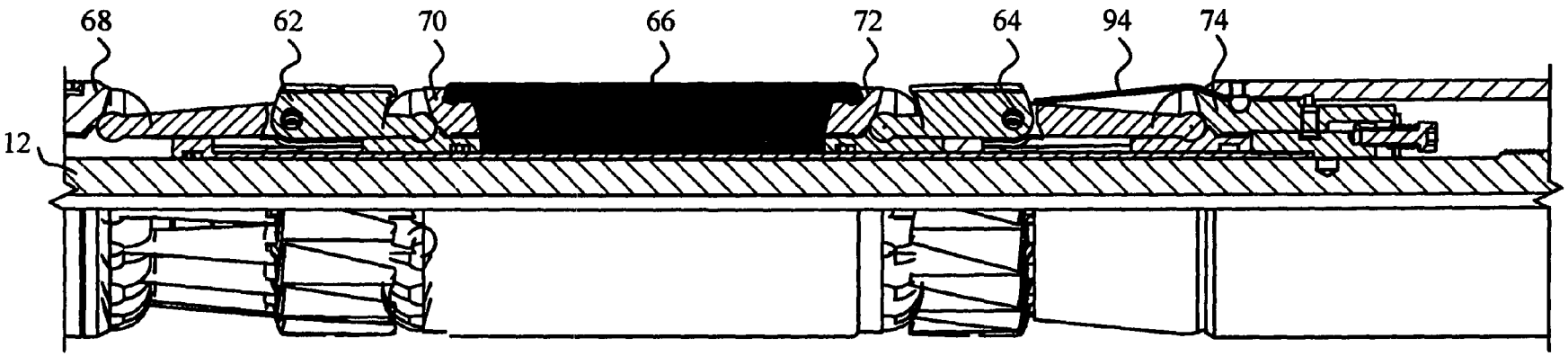
FIG. 3*a* shows a cross sectional view of the packer element and the linking connections in the contracted state.
Figure 3B:
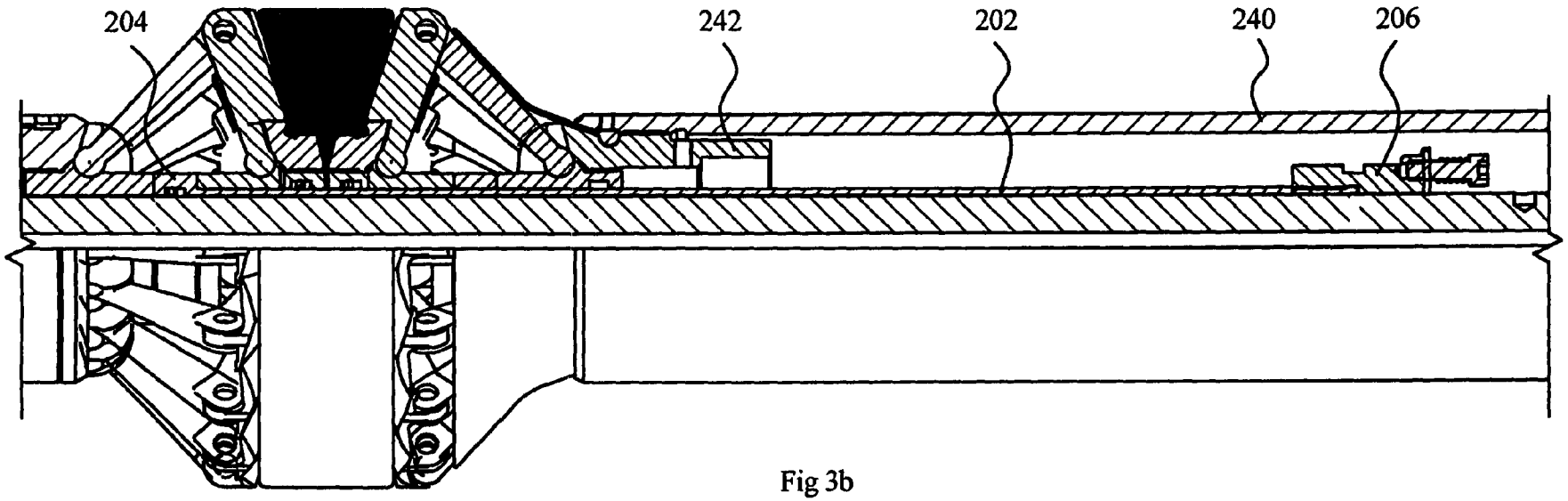
FIG. 3*b* shows a cross sectional view of the packer element and the linking connections in the expanded state.

The packer with mechanical barrier 60 will now be described with reference to FIGS. 3*a* and 3*b*. The packer element 60 comprises two link connections 62, 64 on each side of a packer element 66. Each end of the two link connections 62 is fastened to the well plug 10 by means of fastening devices 68, 70, and each end of the link connection 64 is fastened to the well plug 10 by means of fastening devices 72, 74. The fastening devices 68, 70, 72, 74 are disposed axially displaceable around the shaft 12 of the well plug 10. The fastening device 68 is fastened to the spring device 32 of the anchoring device 20 (FIGS. 2*a* and 2*b*). The displacement means 202 is radially disposed between the fastening devices 68, 70, 72, 74 and the shaft 12, and has a protrusion 204 between the fastening devices 68 and 70. The displacement means 202 is connected to a locking device 206 (FIG. 3*b*).

Figure 7A:
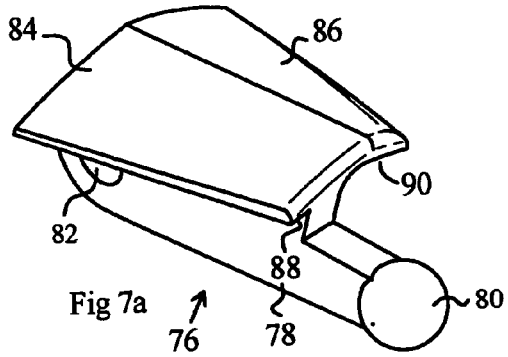
FIGS. 7*a* and 7*b* show a perspective view of an unsymmetrical type of link.
Figure 7B:
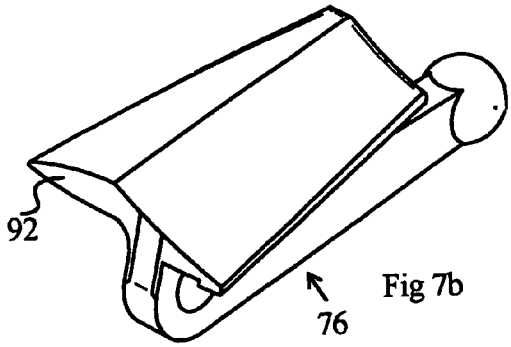
Figure 11:
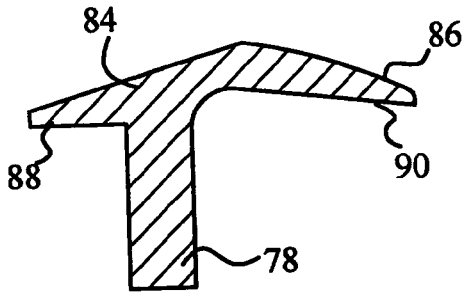
FIG. 11 shows a cross sectional view of the unsymmetrical type of link.

A first embodiment of the link connections 62, 64 will now be described with reference to FIGS. 7*a* and 7*b*. In the following, this embodiment will be referred to as an unsymmetrical link connections. There it is shown a link 76 of a link pair making up the link connection 62, 64. The link 76 is meant to support the packer element 66 and the structure of the link is essential. A second link 77 of the link pair making up the link connection 62, 64 can be a corresponding link, but preferably has a simpler structure (shown in FIG. 10) since this link will not be in touch with the packer element 66. The link 77 will be described below. The link 76 has a generally T-shaped cross section, and comprises an arm 78 with an end 80 formed as a ball. The other end of the arm 78 has an opening 82 for pivotable fastening with a bolt or similar to the other link 77 (FIG. 10) making up the link connection 62, 64. Further, the link 76 has an upper supporting surface 84, an upper supporting surface 86, a lower supporting surface 88 under the supporting surface 84 and a lower supporting surface 90 below the upper supporting surface 86. In the present embodiment, the arm 78 is disposed generally under the supporting surface 84. The upper supporting surface 84 and the upper supporting surface 86 form an end surface 92 in the end away from the ball-shaped end 80. The link 76 is shown in cross section in FIG. 11, and it can be seen that the link 76 is unsymmetrical about the axis through the arm 78.

The supporting surface 86 has a radius of curvature adjusted to the outer radius of the well plug. The end surface 92 has a radius of curvature adjusted to the inner radius of the well pipe. Other constructional selections are based on the radius of the well plug and the inner radius of the well pipe.

Figure 8A:
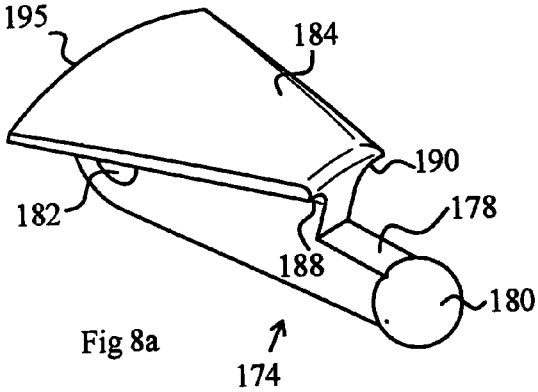
FIG. 8*a* shows a perspective view of the first part of a symmetrical type of link.
Figure 8B:
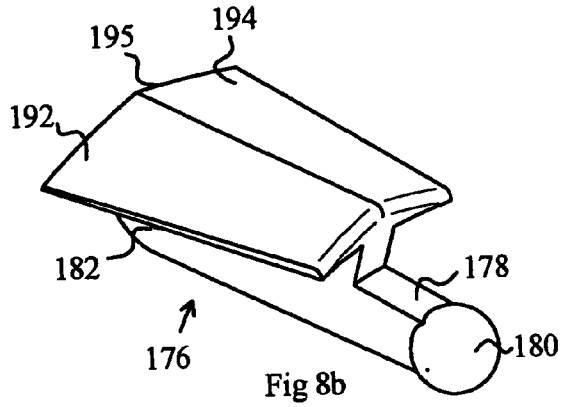
FIG. 8*b* shows a perspective view of the second part of a symmetrical type of link.
Figure 12:
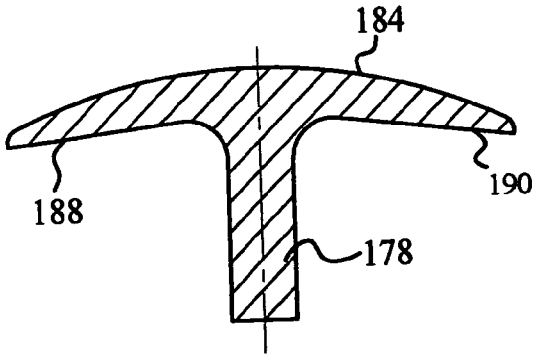
FIG. 12 shows a cross sectional view of the first part of the symmetrical type of link.
Figure 13:
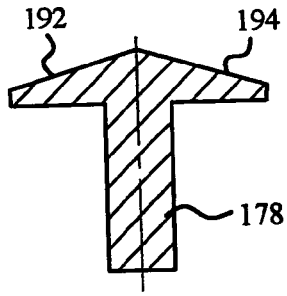
FIG. 13 shows a cross sectional view of the second part of the symmetrical type of link.

A second embodiment of the link connection 62, 64 will now be described with reference to FIGS. 8*a* and 8*b*. In this embodiment, the mechanical barrier comprises links of two types, an outer link 174 (FIGS. 8*a* and 12) and an inner link 176 (FIGS. 8*b* and 13). Both types of links have a generally T-shaped cross section, and in this embodiment will the following be referred to as symmetrical links.

Similar to the embodiment described above, the outer link 174 and the inner link 176 has an arm 178 with a ball-shaped end 180. In the opposite end, the arm 178 comprises an opening 182 for pivotable fastening by means of a bolt or similar to the other link 77 (FIG. 10) of the link pair making up the link connection 62, 64. This embodiment will in the following be referred to as symmetrical links.

The outer link 174 comprises a preferably curved upper supporting surface 184, where the arm 178 is disposed generally centrally below the supporting surface 184. Further, the outer link 174 comprises lower supporting surfaces 188 and 190. The upper supporting surface 184 ends in a preferably curved end surface 195. The upper supporting surface 184 has a radius of curvature adjusted to the outer radius of the well plug, while the end surface 195 has a radius of curvature adjusted to the inner radius of the well pipe. The angles between the vertical axis of the arm 178 and the lower supporting surfaces 188 and 190 are preferably less than 90°.

The inner link 176 has two upper supporting surfaces 192 and 194, each having an angle less than 90° relative to the vertical axis of the arm 178. The supporting surfaces 192 and 194 also end in a preferably curved end surface 195, as described above for the outer link 174.

The links 76 and 174 are preferably formed such that the width of the upper supporting surface(s) increase with length away from the end 80. This can be seen in FIG. 7*a*, 7*b* 8*a*, 8*b*.

The link 77 comprises, for example, an arm 78 with a ball-shaped end 80 and an opposite forklike end 81, meant to be connected to the link 76, 174, 176 by means of a fastening device, such as a bolt or similar (FIG. 10). The same link 77 is preferably also used for the anchoring device 20.

A ring element 100, being a part of the fastening device 68, 70, 72, 74, is formed with a cylindrical section 101 (shown in FIG. 9). The ring element 100 has a number of recesses 102, in which the ball-shaped ends 80 of each link are pivotable accommodated. When all links 76 are installed in their respective recesses 102, an obstructive element (not shown) is inserted on the outside of the cylindrical section 101, thereby keeping the links in position in the fastening device. In the illustrated embodiment, sixteen links are placed in each fastening device.

The packer element 66 are, for example, made of an elastomer or similar elastic material. Inside the packer element there can be arranged a layer of axial wires (not shown), of Aramid or similar material, connected to the fastening devices 70 and 72.

Figure 5A:
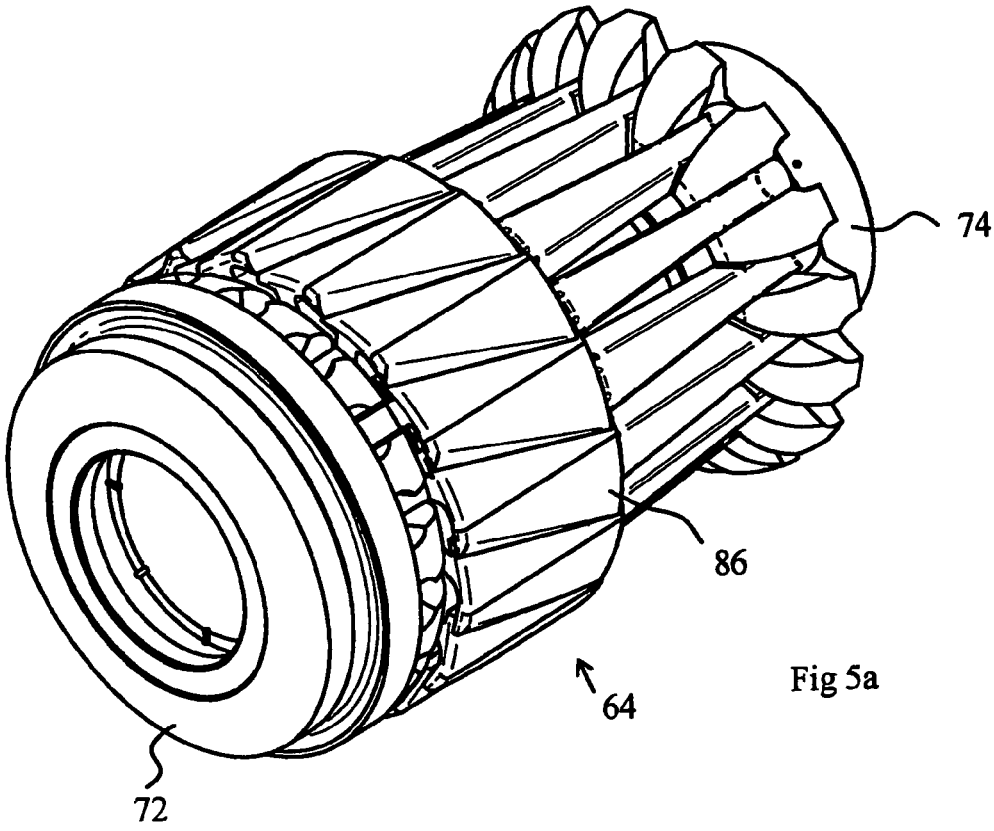
FIG. 5*a* shows a perspective view of a detail of the linking connection in the contracted state.
Figure 5B:
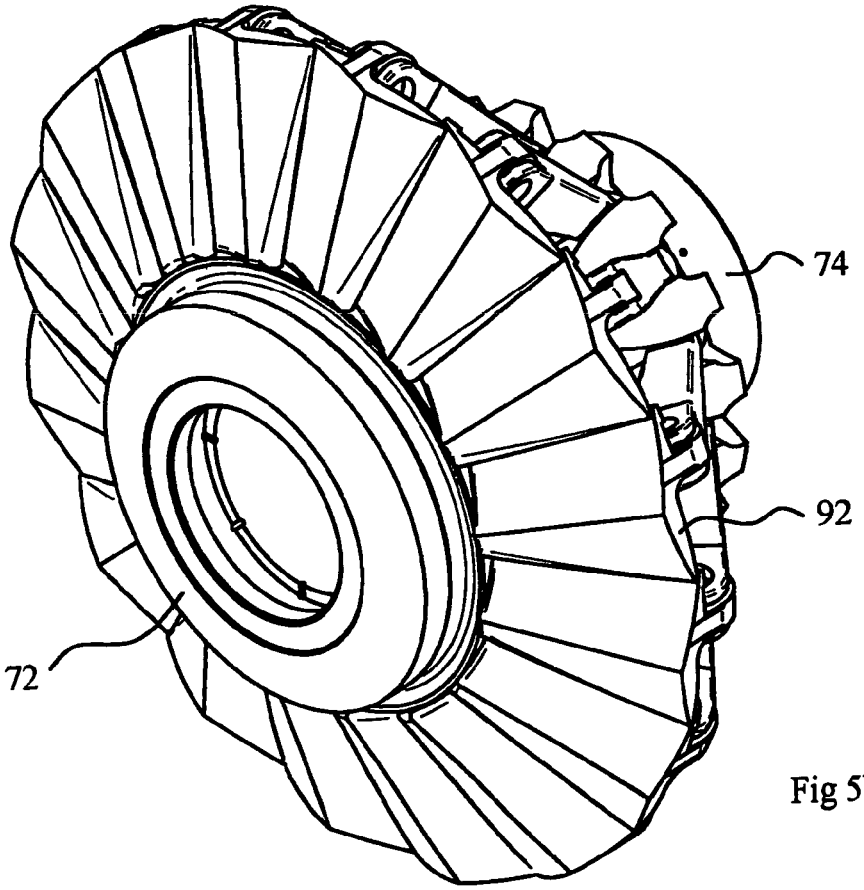
FIG. 5*b* shows a perspective view of a detail of the linking connection in the expanded state.

In FIGS. 5*a* and 5*b* the fastening devices 72 and 74 are shown with the unsymmetrical type of link connection 64 therebetween. When the well plug 10 is set, as can be seen in FIG. 5*a*, parts of the upper surface 84 lay under the lower supporting surface 90 of the the adjacent link. When the fastening device 74 is pushed towards the fastening device 72 at the setting of the well plug 10 in the well, each link is separately pushed radially outward, and makes a nearly complete wall as a support for the packer element 66. Consequently, the packer element 66 is not able to extrude away from the required position, and the required seal with the well bore is achieved. In the position shown in FIG. 5*a*, a smaller part of the upper surface 84 is still located under the lower surface 90 of the adjacent links, and when the fastening device 74 is pulled axially away from the fastening device 72, the contracted position shown in FIG. 5*a* is achieved.

Figure 6A:
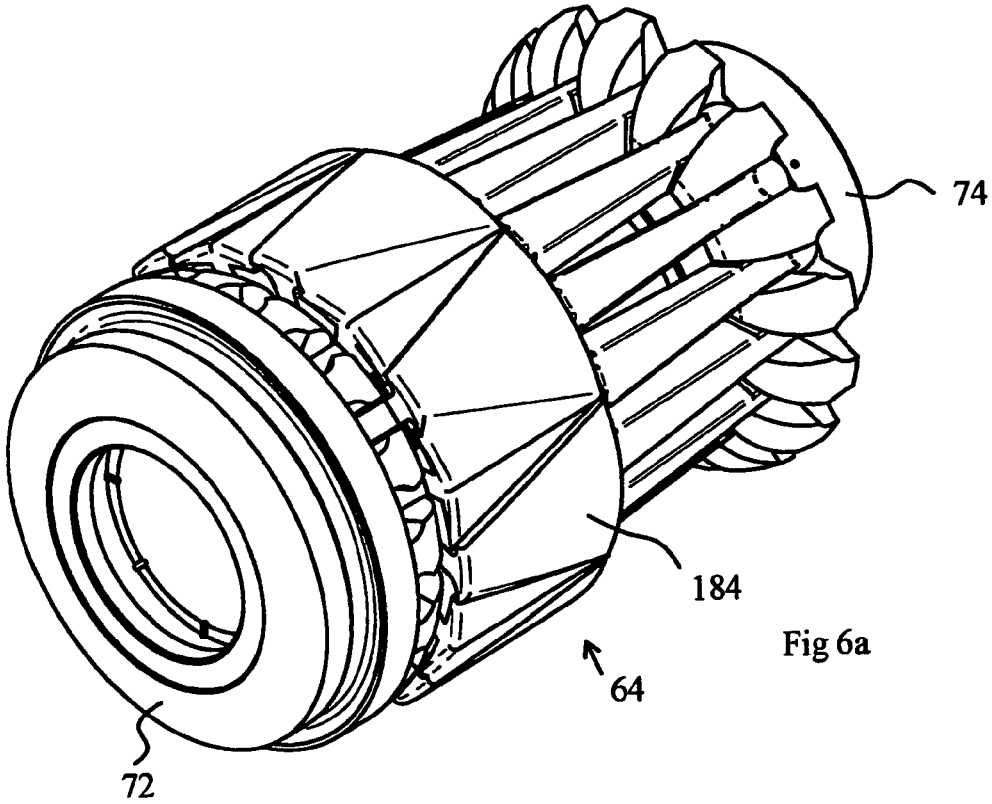
FIG. 6*a* shows a perspective view of a second embodiment of a detail of the linking connection in the contracted state.
Figure 6B:
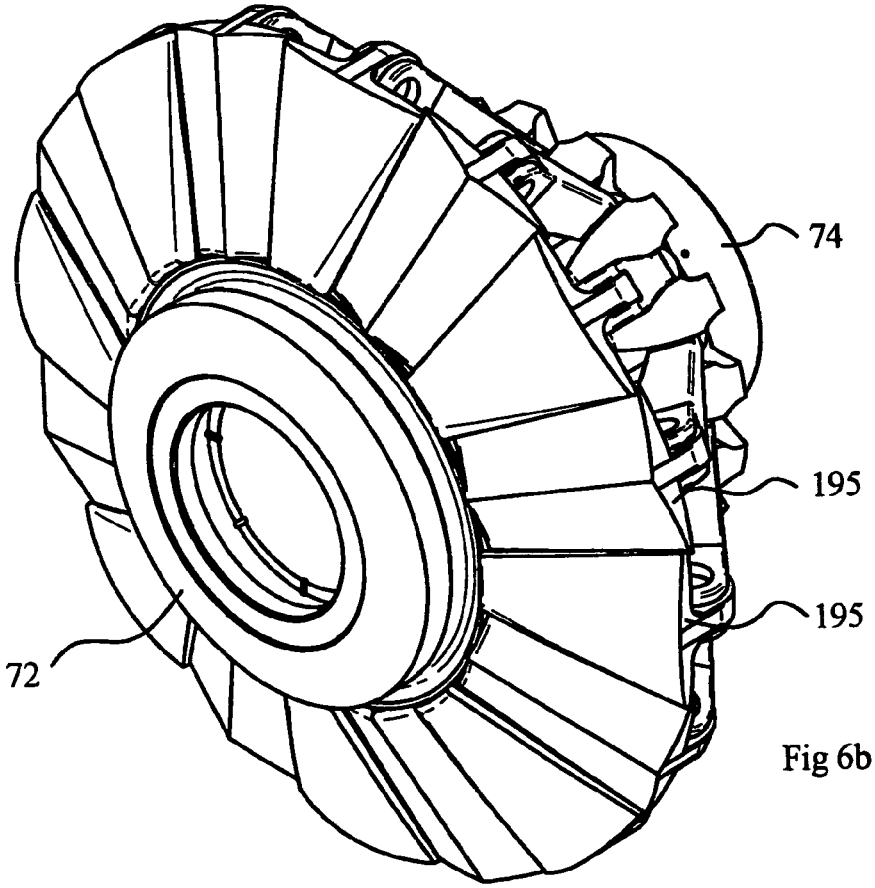
FIG. 6*b* shows a perspective view of a second embodiment of a detail of the linking connection in the expanded state.

The corresponding function applies to the symmetrical type of link connection 64 shown in FIGS. 6*a* and 6*b*. Alternately, the fastening devices 72 and 74 have outer links 174 and inner links 176 placed in the recesses 102. In the contracted position shown in FIG. 6*a* the lower supporting surface 190 of the link 174 is located towards the upper supporting surface 192 of the first adjacent link 176, while the lower surface 188 is located towards the upper supporting surface 194 of the second adjacent link 176. The curvature of the upper supporting surface 184 results in a generally circular outer surface of the contracted link connection 64. When the fastening device 74 is pushed towards the fastening device 72 at the setting of the well plug 10 in the well, each link is separately pushed radially outward, and makes a nearly complete wall as a support for the packer element 66. Consequently, the packer element 66 is not able to extrude away from the required position, and the required seal with the well bore is achieved. The curvature of the end surface 195 results in the links making a nearly complete circular wall.

Figure 4B:
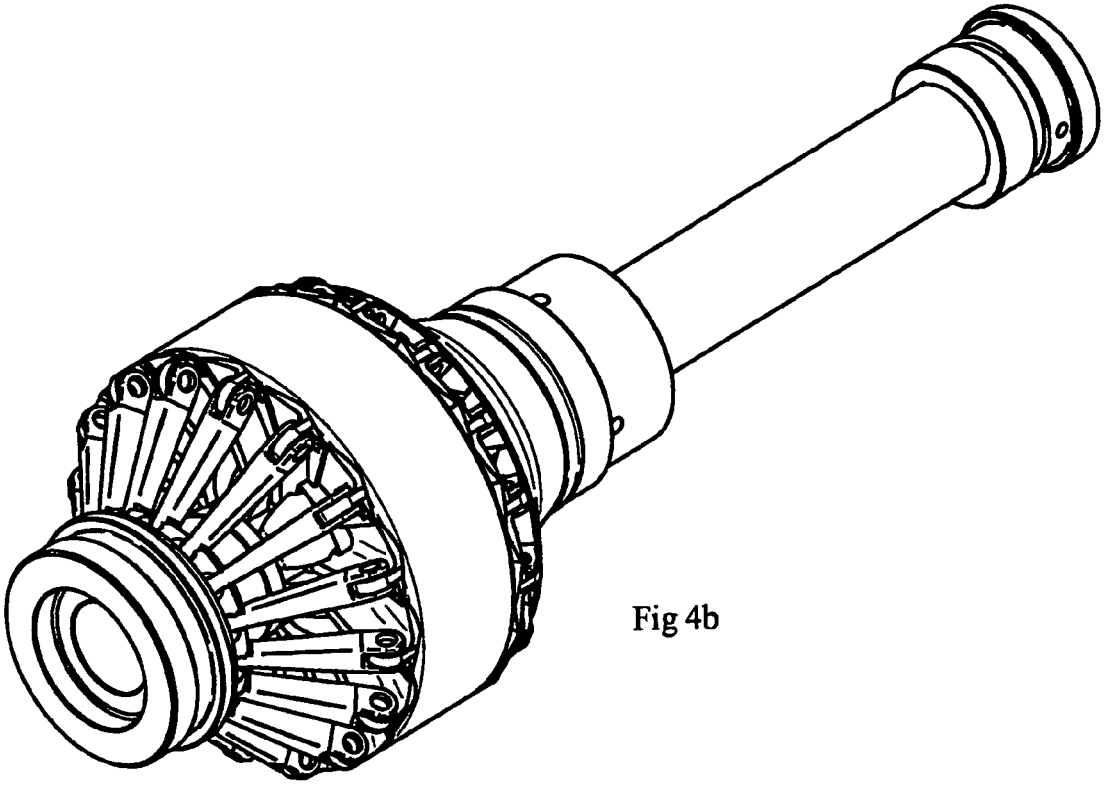
FIG. 4*b* shows a perspective view of the packer element and the linking connections in the expanded state.

The compression of the packer elements 66 is shown in detail in FIG. 4*b*. Here, the fastening devices 68 and 70 are shown with the link connection 62 therebetween, while the fastening devices 72 and 74 are shown with the link connection 64 therebetween on the other side of the packer element 66. Here the unsymmetrical type of links are shown.

Figure 4A:
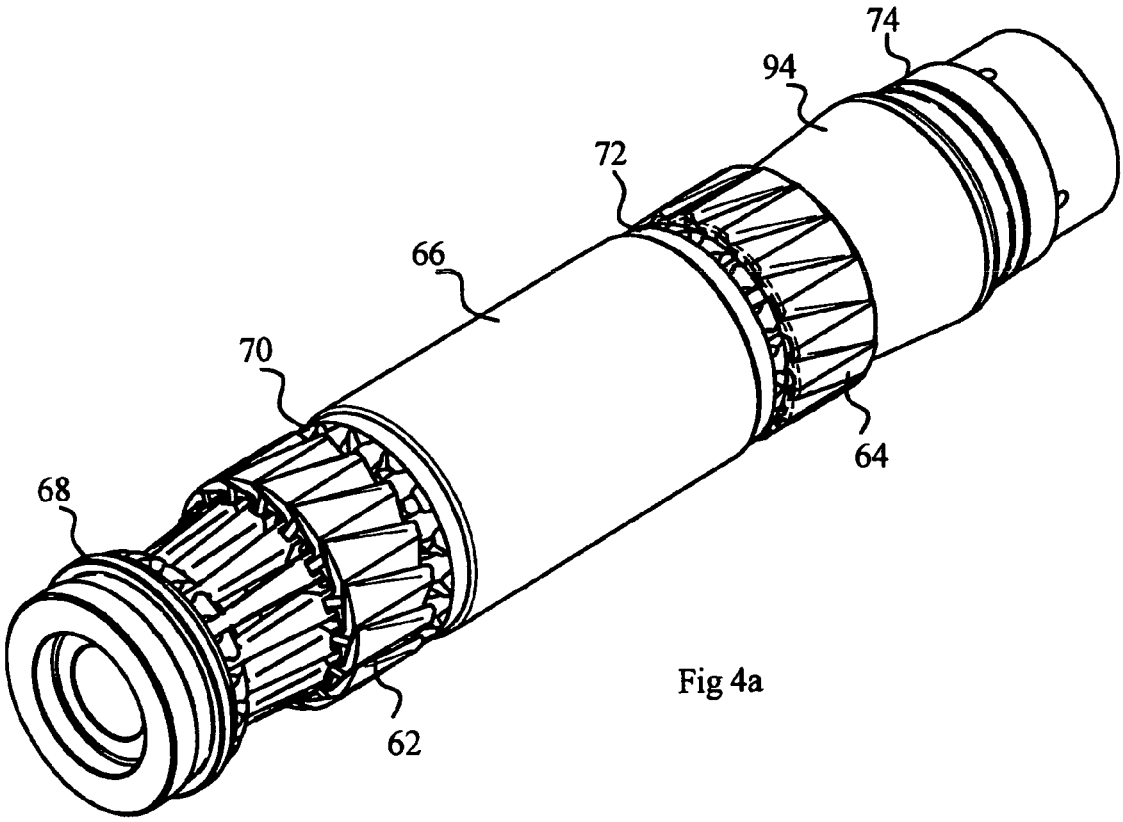
FIG. 4*a* shows a perspective view of the packer element and the linking connections in the contracted state.

A flexible enclosure or sleeve 94 is preferably disposed around one of the link pairs of the link connection 64 (FIG. 3*a*, 4*a*), thereby achieving a mechanical tight barrier towards the packer element 66 and the upper part of the well plug 10. Consequently dirt and remains in the well which may clog and block the movement of the link connection 64 is avoided.

The control device 200 comprises the displacement means 202, an operation means 240 and the locking device 206. The locking device will now be described with reference to FIGS. 3*b*, 15*a* and 15*b*.

The locking device 206 has a generally cylindrical shape and is arranged axially displaceable along the shaft 12 of the well plug 10. As described above, the locking device 206 is fastened to the displacement means 202. Furthermore, the locking device 206 comprises a generally sloping surface 208. In this way, fastening points 210 for fastening devices 212 are axially displaced in relation to each other. In the illustrated embodiment the locking device 206 has two fastening points for two fastening devices 212. The fastening device 212 is, for example, a screw with a head 214, a smooth part 216 and an male threaded part 218 for fastening the screw to the female threaded fastening part 210. The lower fastening device is generally longer than the upper fastening device, such that the heads 214 of the fastening devices 212 are located axially opposite to each other.

Figure 15A:
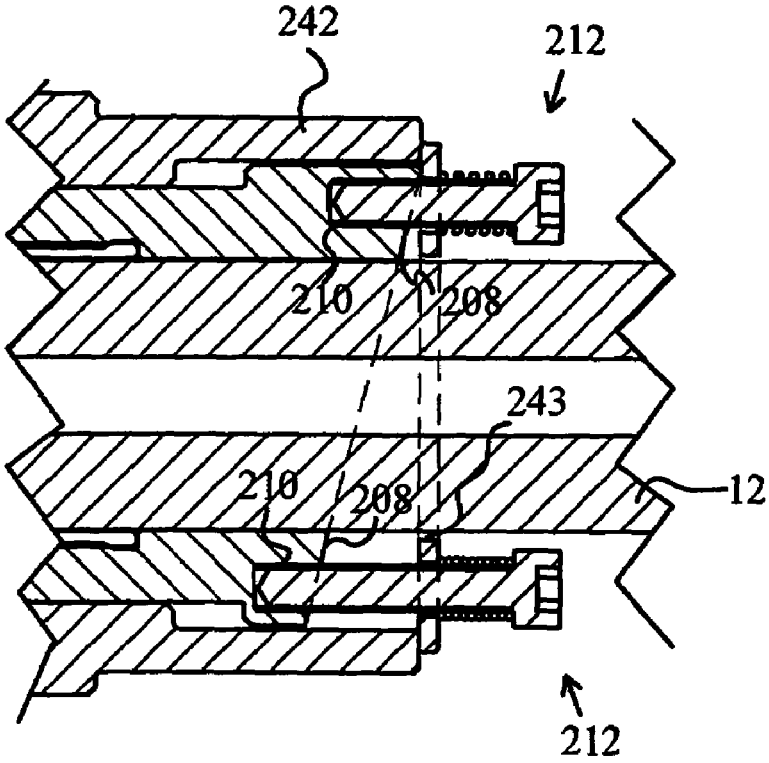
FIG. 15*a* shows an embodiment of a locking device in detail, where the locking device is being released.
Figure 15B:
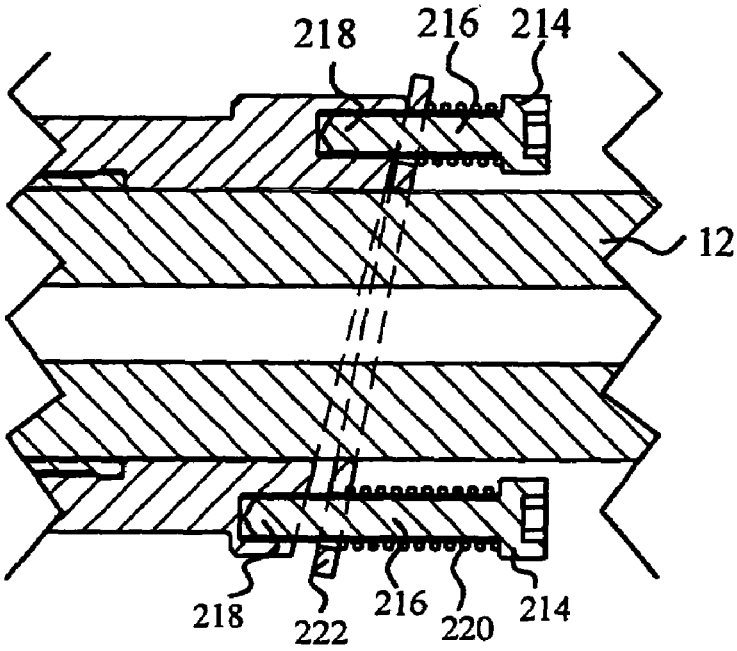
FIG. 15*b* shows an embodiment of a locking device in detail, where the locking device is in locked position.
Figure 16A:
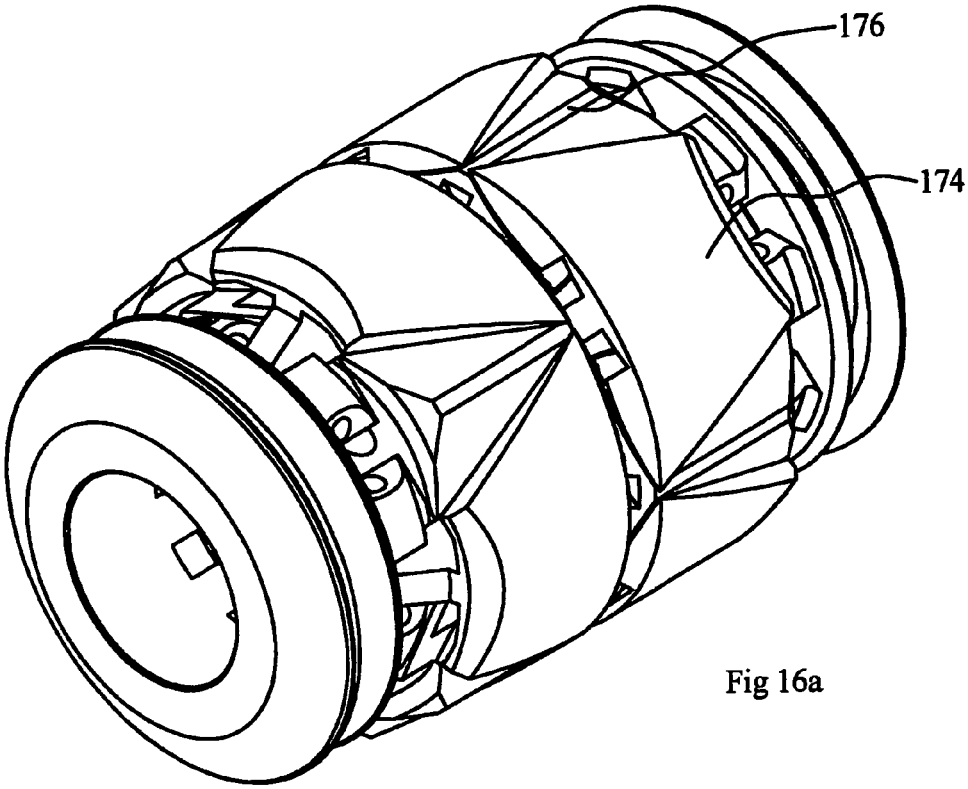
FIGS. 16*a* and 16*b* show an embodiment of the connection device in the expanded and the contracted state respectively, where the links forming each link pair are of the same type.
Figure 16B:
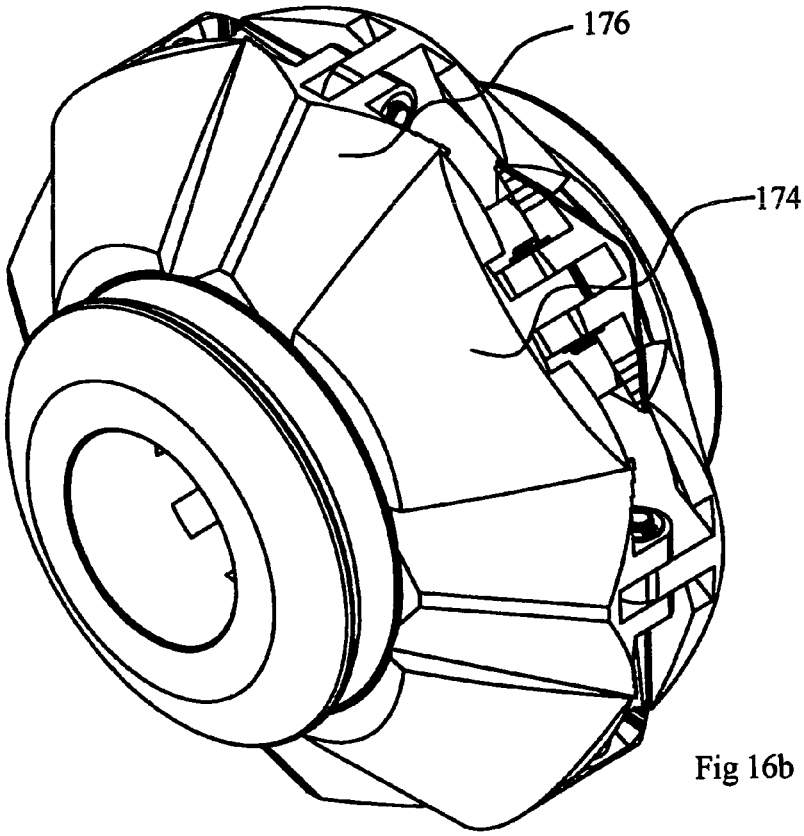

Around the smooth part 216 of the fastening devices 212 there is arranged a spring 220 and a frictioning device 222, such as a disc. The spring 220 pushes the frictioning device 222 towards the generally sloping surface 208, thereby causing the frictioning device 222 to adjust parallel to the sloping surface 208 and consequently, friction is applied to the shaft 12. A releasing device 242 fastened to the operation means 240 keeps the frictioning device 222 in a position perpendicular to the centre line of the well plug, and consequently a clearance 243 between the frictioning device 222 and the shaft 12 is created. In this position, as shown in FIG. 15*a*, the locking device 206 will not be in active locked position, and the displacement means 202 can be moved axially backwards (i.e. to the right in the drawing) in relation to the shaft 12. When the release device 242 leaves the locking device 206 as shown in FIG. 15*b*, the spring 220 will push the frictional device 222 towards the sloping surface 208 and consequently, the clearance 243 will be eliminated when physical contact between the frictional device 222 and shaft 12 occur. The displacement means 202 will then prevent axial movement along the shaft 12.

The setting of the well plug 10 will now be described with reference to FIGS. 1*a* and 1*b*. The well plug 10 is guided down into the well bore in the position shown in FIG. 1*a*, and here the anchoring device 20 and the packer element with two mechanical barriers 60 are then actively contracted. The term active indicates that the operation means 240, in the form of an external sleeve or similar, is held drawn to the right in FIG. 1*a* during the setting, thereby preventing the anchoring device 20 and the packer element with two mechanical barriers 60 from radial expansion. Accordingly, the well plug 10 has a considerable smaller diameter that the well bore, and it would be relative simple make the well plug to pass narrower sections, such as valves and nipples in the well bore.

Figures 1A, 1B, 1C:
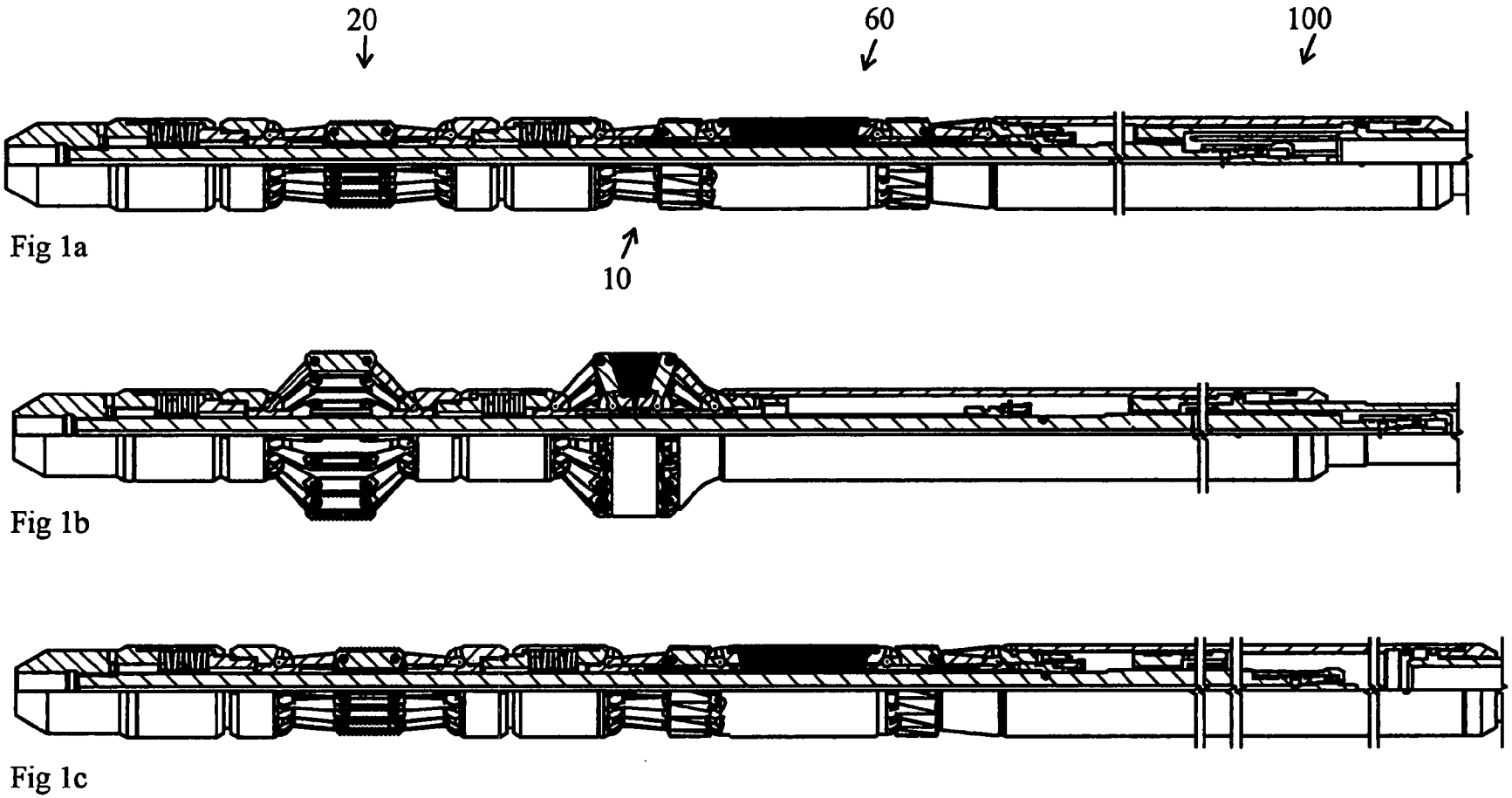
FIG. 1*a* shows a well plug according to the invention in the contracted state as the well plug is set into the well.
FIG. 1*b* shows a cross sectional view of the well plug in the expanded state it will have when in the pipe.
FIG. 1*c* shows a cross sectional view of the well plug in the contracted state when the well plug is retrieved.

At the well plug setting, the displacement means 202 is first pushed to the left in FIG. 1*b* while the operation means 240 is kept in position. Consequently, the anchoring device 20 is radially expanded while the packer element with two mechanical barriers 60 is kept contracted. The locking device 206 prevents the displacement of the displacement means 202 to the right, and when the desired pressure from the anchoring device 20 towards the well bore is achieved, this pressure is maintained. In addition, the spring devices 32, 34 provides a pressure to the anchoring device 20, in such a way that forces occurring due to rapid pressure changes are absorbed.

Thereafter, the operation means 240 is pushed to the left in FIG. 1*b* in known manner, and the link connection 62, 64 compresses the packer element 66 as shown in detail in FIG. 4*b*. After a while the packer element 66 becomes compressed, as shown in FIG. 4*b*, and the packer element 66 forms a pressure tight seal in the well bore. The operation means 240 is then locked in this position by means of locking rings or other known technology (not shown).

The retrieval of the well plug 10 will now be described with reference to FIG. 1*b* and 1*c*. First, a removal tool (not shown) is connected to the right end of the well plug 10, and the pressure difference between each side of the packer element 66 is equalized in a known manner by means of a valve device. The locking rings (not shown) holding the well plug 10 in expanded position are released in known manner. Thereafter, the operation means 240 is pulled to the right in FIG. 1*c*, thereby contracting the packer element with the two barriers 60. The locking device 206 ensures that the anchoring device 20 maintains the grip in the well bore. The axial wires (not shown) embedded in the packer element will contribute to the contraction of the packer element 66 to its initial shape.

After a while the operating means 240 will be pulled so far to the right that the release device 242 releases the locking device 206 as described above. Accordingly, the displacement means 202 is pulled to the right. The anchoring device 20 is radially contracted, and the well plug 10 can be retrieved from the well bore.

If the packer element is damaged or even broken into two pieces during the removal process, the operation means 240 does not have physical contact with the link connection 62. Usually, this could cause the anchoring device 20 and the link connection 62 to remain in the expanded position (FIG. 1*b*), and as a consequence it can be very difficult to get the well plug 10 out of the well bore. Since the displacement means 202 has a protrusion 204, the link connection 62 can be actively contracted, and accordingly, the anchoring 20 becomes contracted.

The invention claimed is:

1. A method for setting and retrieval of a well plug, wherein the well plug is first moved to a selected position in the well bore, the method comprising the following steps:

mounting a packer element and an anchoring device on a shaft, the packer element and the anchoring device each being movable relative to the shaft between retracted and expanded positions;

mounting a displacement member on the shaft and connecting the anchoring device to the displacement member;

mounting an operating member on the shaft and connecting the operating member to the packer element with a link connection device;

connecting a locking device between the operating member and the displacement member that has a released position wherein the displacement member will move axially in unison with the operating member when the operating member is moved in a first direction and a locked position wherein the operating member may continue moving in the first direction relative to the displacement member;

with the locking device in the released position, moving the operating member axially in the first direction, causing the displacement member to move axially along with the operating member relative to the shaft, thereby moving the anchoring device radially out from the shaft to the expanded position such that anchoring in the well bore wall is achieved; then locking the displacement member in the locked position with the locking device; and moving the operating member further axially in the first direction relative to the displacement member and the shaft, thereby moving the packer element via the link connection radially out from the shaft from the retracted to the expanded position such that the packer element forms a pressure tight seal against the well bore wall.

2. The method according to claim 1, further comprising retrieving the well plug by the following steps:

moving the operating member axially in a second direction, such that the link connection moves the packer element radially inwards to the retracted position, while the anchoring device is still maintained in the expanded position anchoring the well plug against the well bore wall; then moving the operating member further axially in the second direction, causing the locking device to move to the released position and the displacement member to begin moving axially in unison with the operating member, causing the anchoring device to move radially inwards to the retracted position; then pulling the well plug out of the well bore.

3. In a retrievable well plug device, comprising a shaft with a link assembly mounted thereon, an operating member connected to one end of the link assembly by a first connection device, a packer element mounted around the shaft and to the link assembly by a second connection device, wherein the link assembly comprises a number of first and second links, pivotally connected to each other, such that moving the link assembly and the packer element towards each other, with the operating member causes the link assembly and the packer element to expand radially relative to the shaft from a contracted to an expanded position, the improvement comprising:

at least one of the first links having a generally T-shaped cross sectional profile and comprising an arm with one end fastened one of the fastening devices and another end fastened to one of the second links of the link assembly;

wherein at least one of the first links further comprises at least one supporting surface generally transverse to the arm, such that the supporting surface overlaps with supporting surfaces of adjacent ones of the first links to form an approximately tight mechanical barrier against the packer element in the expanded position.

4. The device according to claim 3, wherein the arm of said at least one of the first links is disposed generally radially inward from the supporting surface relative to the shaft.

5. The device according to claim 4, wherein the supporting surface of said at least one of the first links further comprises an inner supporting surface and an outer supporting surface, such that at least a portion of the outer supporting surface of said one of the first links overlaps and engages a portion of the inner supporting surface of an adjacent on of the first links in the contracted and in the expanded positions.

6. The device according to claim 3, wherein the arm of said at least one of the first links is disposed generally radially inward from the supporting surface along a line midway between side edge of the supporting surface.

7. The device according to claim 3, wherein the supporting surface is curved.

8. The device according to claim 7, wherein the supporting surface has a radius of curvature approximately equal to an outer radius of the packer element in the expanded position.

9. The device according to claim 3, further comprising a flexible enclosure disposed radially on the outside of the links assembly for the protection of the link assembly against debris.

10. The device according to claim 3, wherein said at least one of the first links is formed such that the width of the supporting surface increases as the distance from one of the ends of the arms increases.

11. The device according to claim 6, wherein the supporting surface of said at least one of the links further comprises an inner supporting surface generally on an opposite side of an outer supporting surface so that at least a portion of the outer supporting surface of said one of the first links is supported against a portion of the inner supporting surface of an adjacent one of the first links in the contracted and the expanded positions.

12. In a retrievable well plug device, having a shaft, an anchoring device having a number of gripping devices mounted to the shaft, wherein the gripping devices upon setting of the well plug expand radially relative to the shaft, thereby providing an anchoring of the well plug to the well bore wall, the improvement comprising:

a securing device carried by the shaft;

a plurality of links, each of which has one end pivotally secured to the securing ring and another end pivotally secured to one of the gripping devices; and wherein moving the securing device relative to the shaft and to the gripping devices causes the gripping devices to move radially outward relative to the shaft.

13. The device according to claim 12, wherein the securing device comprises axially spaced apart securing rings separated from each other by at least one spring device for exerting a spring force against the gripping devices while in an expanded position.

14. The device according to claim 12, wherein each of the links has a longitudinal axis that in a contracted position intersects an axis of the shaft at a positive angle.

15. The device according to claim 12, wherein each of the links has a supporting end surface that abuts a supporting end surface of one of the gripping devices while in a contracted position.

16. The device according to claim 12, wherein each of the links has a supporting end surface that abuts a supporting end surface of one of the gripping devices while in an expanded position.

* * * * *